US009926815B2

(12) United States Patent
Lehmann et al.

(10) Patent No.: US 9,926,815 B2
(45) Date of Patent: Mar. 27, 2018

(54) ADJUSTABLE CAMSHAFT

(71) Applicant: THYSSENKRUPP PRESTA TECCENTER AG, Eschen (LI)

(72) Inventors: Martin Lehmann, Mittelndorf (DE); Bernd Mann, Zschopau (DE); Michael Kunz, Chemnitz (DE); Uwe Dietel, Lichtentanne (DE); Jürgen Meusel, Dittmannsdorf (DE); Manfred Muster, Ludesch (AT); Markus Niederlechner, Schaanwald (LI); Marko Curlic, Nendeln (LI)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 0 days.

(21) Appl. No.: 15/039,534

(22) PCT Filed: Nov. 27, 2014

(86) PCT No.: PCT/EP2014/003177

§ 371 (c)(1),
(2) Date: May 26, 2016

(87) PCT Pub. No.: WO2015/078588

PCT Pub. Date: Jun. 4, 2015

(65) Prior Publication Data

US 2017/0030229 A1 Feb. 2, 2017

(30) Foreign Application Priority Data

Nov. 29, 2013 (DE) ..... 10 2013 113 255

(51) Int. Cl.
*F01L 1/46* (2006.01)
*F01L 1/047* (2006.01)
(Continued)

(52) U.S. Cl.
CPC ..... *F01L 1/047* (2013.01); *F01L 1/34* (2013.01); *F01L 1/34413* (2013.01); *F01L 2001/0473* (2013.01); *F01L 2001/0476* (2013.01)

(58) Field of Classification Search
CPC ..... F01L 2001/0473; F01L 2001/0476; F01L 1/34413
(Continued)

(56) References Cited

U.S. PATENT DOCUMENTS

2008/0257104 A1* 10/2008 Lancefield ..... F01L 1/047 74/568 R
2008/0257290 A1* 10/2008 Lettmann ..... F01L 1/047 123/90.17
(Continued)

FOREIGN PATENT DOCUMENTS

CN 1817716 A 8/2006
CN 101523068 A 9/2009
(Continued)

OTHER PUBLICATIONS

International Search Report for PCT/EP2014/003171 dated Feb. 23, 2015 (dated Mar. 3, 2015).
(Continued)

*Primary Examiner* — Jorge Leon, Jr.
(74) *Attorney, Agent, or Firm* — thyssenkrupp North America, Inc.

(57) ABSTRACT

An adjustable camshaft for a valve drive of an internal combustion engine may include an inner shaft extending through an outer shaft with a cam element disposed on the outer shaft. The cam element may be connected rotationally conjointly to the inner shaft. The cam element may have a shaft passage with an internal bearing surface, which, together with a bearing surface on an outer side of the outer
(Continued)

shaft, forms a plain bearing arrangement for the rotatable arrangement of the cam element on the outer shaft. The bearing surface on the outer side of the outer shaft and/or the internal bearing surface of the shaft passage of the cam element may include one or more sections with a spherical shape.

11 Claims, 3 Drawing Sheets

(51) Int. Cl.
*F01L 1/344* (2006.01)
*F01L 1/34* (2006.01)

(58) Field of Classification Search
USPC ..... 123/90.17
See application file for complete search history.

(56) References Cited

U.S. PATENT DOCUMENTS

| | | | | |
|---|---|---|---|---|
| 2010/0132640 | A1* | 6/2010 | Methley | F01L 1/047 123/90.6 |
| 2012/0160055 | A1* | 6/2012 | Tateno | F01L 1/3442 74/567 |

FOREIGN PATENT DOCUMENTS

| | | | |
|---|---|---|---|
| DE | 115523 | A | 10/1975 |
| DE | 3144720 | A | 5/1983 |
| DE | 10054622 | A1 | 5/2002 |
| DE | 102006051332 | A | 5/2008 |
| DE | 102010032254 | A1 | 1/2012 |
| DE | 102012103581 | A1 | 10/2013 |
| EP | 0254058 | A2 | 1/1988 |
| EP | 2000230 | A1 | 12/2008 |
| EP | 2543831 | A1 | 1/2013 |
| EP | 2801436 | A2 | 11/2014 |
| JP | H09144513 | A | 6/1997 |
| WO | 2011070976 | A1 | 6/2011 |

OTHER PUBLICATIONS

English Language Abstract for DE10054622.
Schlecht, Berthold: Maschinenelemente 2 Getriebe-Verzahnungen-Lagerungen, ISBN 978-3-8273-7146-1, (2010), pp. 61-62. [English translation enclosed].
First Chinese Office Action issued in corresponding application No. CN201480074229.8 dated Dec. 5, 2017. [[No English translation available]].

* cited by examiner

ADJUSTABLE CAMSHAFT

CROSS REFERENCE TO RELATED APPLICATIONS

This application is a U.S. National Stage Entry of International Patent Application Serial Number PCT/EP2014/003177, filed Nov. 27, 2014, which claims priority to German Patent Application No. DE 102013113255.3 filed Nov. 29, 2013, the entire contents of both of which are incorporated herein by reference.

FIELD

The present disclosure relates to camshafts and, more particularly, to adjustable camshafts that can be used in internal combustion engines.

BACKGROUND

DE 10 2012 103 581 A1 presents a generic adjustable camshaft having an outer shaft and an inner shaft, and the inner shaft extends through the outer shaft, which is of tubular form, and said inner shaft is rotatable in said outer shaft. By way of a bolt, a cam element which is held rotatably on the outer shaft is connected rotationally conjointly to the inner shaft, such that, in the event of a rotation of the inner shaft relative to the outer shaft, a change in the phase angle of the cam element on the outer shaft is realized.

The cam element which is rotatable on the outer shaft forms, together with a shaft passage in the cam element, a plain bearing arrangement on the outer side of the outer shaft, and the plain bearing arrangement is supplied with lubricant via a gap between the inner shaft and the outer shaft.

The cam element is in contact with a pick-off element to the valve drive, whereby it is often the case that radially asymmetrical forces act on the cam element. This can give rise to tilting of the cam element relative to the longitudinal axis of the camshaft, and to increased loads in the outer regions of the bearing surfaces, which can lead to so-called edge loading. This arises if, in the event of tilting of the cam element on the otherwise cylindrical outer shaft, only the marginal region of the bearing surface, that is to say for example the outer locally limited region in the longitudinal axis direction, of the shaft passage, or the marginal region of the seating point on the outer shaft, accommodates the entirety of the operating forces on the cam element. Finally, such edge loading leads to increased wear and to increased friction between the cam element and the outer shaft, and must therefore be avoided.

DE 100 54 622 A1 has disclosed a valve actuation element, and a rolling-bearing-mounted outer ring is provided which is in contact with the cam contour of a cam element. The outer ring is in a rolling-bearing-mounted configuration by way of an inner ring, and the bearing unit formed by the outer ring and the inner ring is mounted in tiltable fashion on a bearing bolt. For this purpose, the bearing bolt is of spherical form. Owing to the degree of freedom that is obtained for a tilting movement of the outer ring to be performed, said outer ring can be guided against the cam contour of the cam element so as to be in linear contact therewith, without edge loading arising between the cam contour and the pick-off element, that is to say the outer ring. In this case, however, the arrangement of a rolling bearing unit which is mounted in tiltable fashion on a bearing bolt cannot readily be implemented for the mounting of a cam element on an outer shaft of an adjustable camshaft.

DETAILED DESCRIPTION

Figure 1:
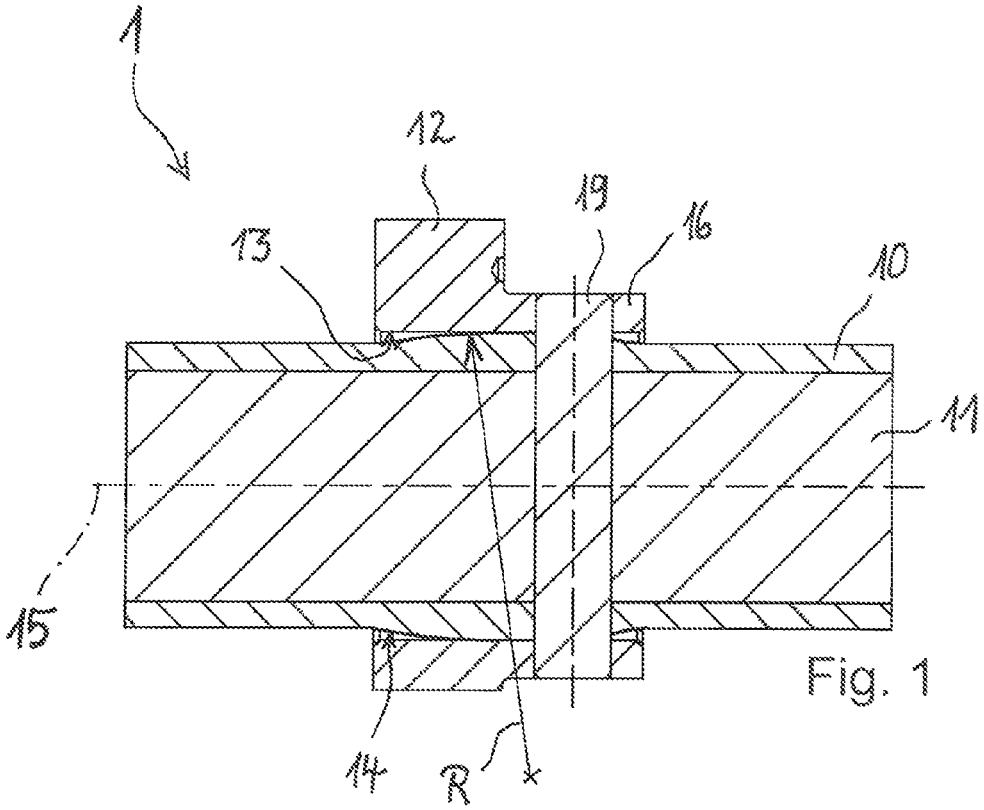
FIG. 1 is a cross-sectional view of an example adjustable camshaft including a spherical bearing surface formed by an outer side of an outer shaft.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

The present disclosure generally concerns adjustable camshafts for a valve drive of an internal combustion engine. In some examples, a camshaft may have an outer shaft and an inner shaft that extends through the outer shaft. A cam element may be disposed on the outer shaft that is connected rotationally conjointly to the inner shaft. The cam element may have a shaft passage with an internal bearing surface, which, together with a bearing surface on an outer side of the outer shaft, forms a plain bearing arrangement for the rotatable arrangement of the cam element on the outer shaft.

One example object of the present disclosure is to further develop an adjustable camshaft for the valve drive of an internal combustion engine, with improved mounting of a cam element on the outer shaft of the camshaft. One of the example objects is to prevent so-called edge loading in the plain bearing arrangement of the camshaft on the outer shaft.

The invention encompasses the technical teaching whereby at least one of the bearing surfaces is formed, at least in sections, with a spherical crowned shape.

By way of a spherical shape of at least one of the bearing surfaces, for the rotational mobility of the cam element on the outer shaft about the longitudinal axis, a further degree of freedom is realized for a slight tilting movement of the cam element on the outer shaft to be performed. In addition to the bearing clearance that is provided in any case in plain bearing arrangements, it is achieved by way of the spherical shape that the radial gap increases outwardly on at least one side over the axial length of the bearing surfaces. If the cam element tilts slightly on the outer shaft, a longer axial region of the bearing surfaces which slide on one another imparts a load-bearing action, whereby the formation of edge loading is prevented. Regardless of the tilting movement of the cam element, it is the case, owing to the bearing surface that deviates from a cylindrical shape, that it is not possible in any tilting direction, even under adverse asymmetrical introduction of the operating forces into the cam element, for only a limited region of the bearing surface to impart a load-bearing action.

Here, the spherical shape according to the invention of at least one of the bearing surfaces describes a shape of the bearing surfaces which is of rotationally symmetrical form and which generates a bearing clearance between the two bearing surfaces which varies over the axial length of the bearing surface. The spherical shape is in this case formed such that the bearing clearance, that is to say the remaining radial gap between the bearing surfaces, becomes larger toward at least one outer side of the bearing surface. Thus, according to the invention, the spherical shape forms a deviation from the cylindrical shape, in such a way that the surface in the shaft passage, and/or the outer side of the outer shaft, is domed toward the respectively opposite bearing surface, with the formation of a radial gap constriction.

During the operation of the adjustable camshaft, it is thus possible for the cam element to perform a periodic tilting movement which follows the likewise periodic exertion of force by a pick-off element, by way of which tilting movement it is even possible to generate a pumping effect of lubricant into the gap between the bearing surfaces. In this way, the supply of lubricant into the bearing gap between the bearing surfaces can be improved, and in particular, a situation is avoided in which lubricant present in the bearing gap becomes excessively aged and is not exchanged for fresh lubricant.

The geometrical deviation of the shape of the bearing surface from a cylindrical shape is in this case so small that the contact between the cam track of the cam element and the pick-off element is not adversely affected. In particular, it is even possible to achieve that the cam element maintains linear contact with respect to the pick-off element in an improved manner, without edge loading also being able to arise in said linear contact. In particular, the spherical shape is of such minimal form that no solid-body contact arises between the bearing surface in the shaft passage and the bearing surface on the outer side of the outer shaft, and a load-bearing lubrication film is maintained even in the case of a tilted arrangement of the cam element on the outer side of the outer shaft.

In one advantageous embodiment, the bearing surface on the outer side of the outer shaft may have a spherical shape, wherein in particular, the spherical shape may have a width which corresponds at least to the length of the plain bearing arrangement in the direction of a longitudinal axis along which the camshaft extends. Here, the width of the spherical shape may correspond to the axial length of the plain bearing arrangement, though provision may also be made whereby the spherical shape has a greater width than the axial length of the plain bearing arrangement. In this way, it can be achieved in particular that the radius generated in the bearing surface by way of the spherical shape can be configured to be very large, giving rise to advantages in terms of manufacture.

In a further possible embodiment, the bearing surface in the shaft passage may have, at least in sections, a spherical shape, such that the shaft passage has a smaller diameter at the inside than at the margin. Here, however, according to present invention, the spherical shape may also be provided in both bearing surfaces, whereby the radial gap enlargements in the direction of the margin of the plain bearing arrangement can add up owing to the two spherical shapes.

The spherical shape in at least one of the bearing surfaces may advantageously be formed in a variety of ways. For example, the spherical shape may be of symmetrical form with respect to the longitudinal axis of the camshaft. Thus, a plain bearing arrangement with bearing surfaces which slide on one another is provided, which plain bearing arrangement has a radial gap constriction realized centrally over the length of the bearing surfaces in the axial direction. It is thus possible for the cam element to tilt in the same way in two opposite tilting directions. For example, the region of the minimum radial gap between the bearing surfaces may be arranged centrally under the cam track of the cam element. The cam element may however also have a cam collar, giving rise to an axially longer design of the cam element. Here, the region of the radial gap constriction may be formed centrally over the entire length of the bearing surface, which is defined by the axial length of the cam element with the cam collar.

In a further variant, the spherical shape in the at least one bearing surface may also be of asymmetrical form. The spherical shape of asymmetrical form may be used in particular in the case of cam elements with a cam collar, which spherical shape may be formed both in the bearing surface in the shaft passage and in the outer side of the outer shaft, specifically at the seating point for the mounting of the cam element. The spherical shape may be formed asymmetrically in the at least one bearing surface such that a radial gap constriction between the bearing surfaces is formed in the section of the cam collar or preferably adjacent to the section of the cam collar. The introduction of force into the cam element occurs basically via the cam track of the cam element, whereby the cam element can perform a slightly periodic tilting movement on the outer shaft. Owing to the symmetrical or asymmetrical spherical shape of at least one of the bearing surfaces, the bearing surfaces roll on one another so as to perform the tilting movement, and owing to the spherical shape according to the invention, no edge loading occurs at the endpoint of the tilting movement.

Here, the spherical shape in at least one of the bearing surfaces need not be formed over the entire axial length of the bearing surface. For example, the at least one bearing surface may have at least one cylindrical section which is formed adjacent to the spherical shape. Provision may also be made whereby the cylindrical section forms an axial elongation of the region of the radial gap constriction, such that, on one side or both sides, the cylindrical section is followed by a spherical shape, by way of which the bearing surface runs off to the margin. Such a contour profile of the bearing surface with a preferably centrally arranged cylindrical section and spherical shapes running off laterally particularly advantageously prevents edge loading from arising in the event of tilting of the cam element, but a load-bearing region for accommodating the operating forces of the cam element, which load-bearing region can accommodate high mechanical loads, is realized on the outer shaft owing to the widened region of a radial gap constriction. The spherical shape in the direction of at least one margin may in this case transition into a marginal radius, by way of which radius the bearing surface forms an axial termination of the plain bearing arrangement.

The spherical shape may have a radial height of, for example, 1 μm to 15 μm, preferably of 2 μm to 10 μm, and particularly preferably of 4 μm to 6 μm. The deviation of the bearing surface from a cylindrical shape is thus extremely small, and may for example be limited to the size range of the bearing clearance.

FIG. 1 to FIG. 6 illustrate different exemplary embodiments of adjustable camshafts 1 for the valve drive of an internal combustion engine, having an outer shaft 10 and having an inner shaft 11 which extends through the outer shaft 10. The inner shaft 11 is rotatable in the outer shaft 10 about the longitudinal axis 15, and in each case only a section of the adjustable camshaft 1 which extends along the longitudinal axis 15 is shown. In the section shown, a camshaft element 12 is situated on the outer side of the outer shaft 10, and the camshaft element 12 is, by way of example, in the form of a collar cam with a cam collar 16, and is connected rotationally conjointly to the inner shaft 11 by way of a bolt 19. If the inner shaft 11 is rotated relative to the outer shaft 10, the cam element 12 likewise rotates on the outer side of the outer shaft 10.

A shaft passage is formed in the cam element 12 for the leadthrough of the outer shaft 10, and the shaft passage forms an internal bearing surface 13 which forms a plain bearing arrangement with the bearing surface 14 on the outer side of the outer shaft 10. By way of said plain bearing arrangement, the cam element 12 is rotatable on the outer shaft 10 over a predefined angle segment about the longitudinal axis 15.

The following exemplary embodiments show various bearing surfaces 13 and 14 in the shaft passage of the cam element 12 and on the outer side of the outer shaft 10, wherein the bearing surfaces 13 and 14 have spherical shapes formed in different ways.

FIG. 1 shows an exemplary embodiment of an adjustable camshaft 1 with a spherical shape of the bearing surface 14 on the outer side of the outer shaft 10. The spherical shape is of symmetrical form and has a width which corresponds approximately to the width of the cam element 12, such that the spherical shape has the width of the seating point of the cam element 12 on the outer side of the outer shaft 10. When forces act on the cam element 12 owing to the contact of the cam element 12 with a pick-off element to the valve drive of the internal combustion engine, said cam element can perform a minimal tilting movement relative to the longitudinal axis 15, such that, during the tilting movement, the bearing surface 13 in the shaft passage of the cam element 12 performs a rolling movement on the spherical bearing surface 14 on the outer side of the outer shaft 10. The connection of the cam element 12 to the inner shaft 11 by way of the bolt 19 in this case need not be assumed to be infinitely rigid, such that small movements can be performed by the cam element 12 despite a press-fit connection of the cam collar 16 to the bolt 19. The spherical shape may be defined by a radius R which, owing to the limited width of the spherical shape, is smaller than that in the exemplary embodiment presented below with reference to FIG. 2.

As an alternative to the form of the spherical shape shown, which is defined by a single radius R about a spatially fixed point, and particularly preferably in addition thereto, the spherical shape of the bearing surface 14 in relation to the longitudinal axis 15 may also be defined by multiple radii formed one behind the other, which may be of different magnitudes than one another. Accordingly, the spherical shape may for example also be formed in the manner of a polygon composed of multiple radii adjacent to one another in the direction of the longitudinal axis 15. In particular, a central radius R as per the illustration may be greater than marginal radii, which can run off in edge-free and step-free fashion into the cylindrical surface of the outer shaft 10.

Figure 2:
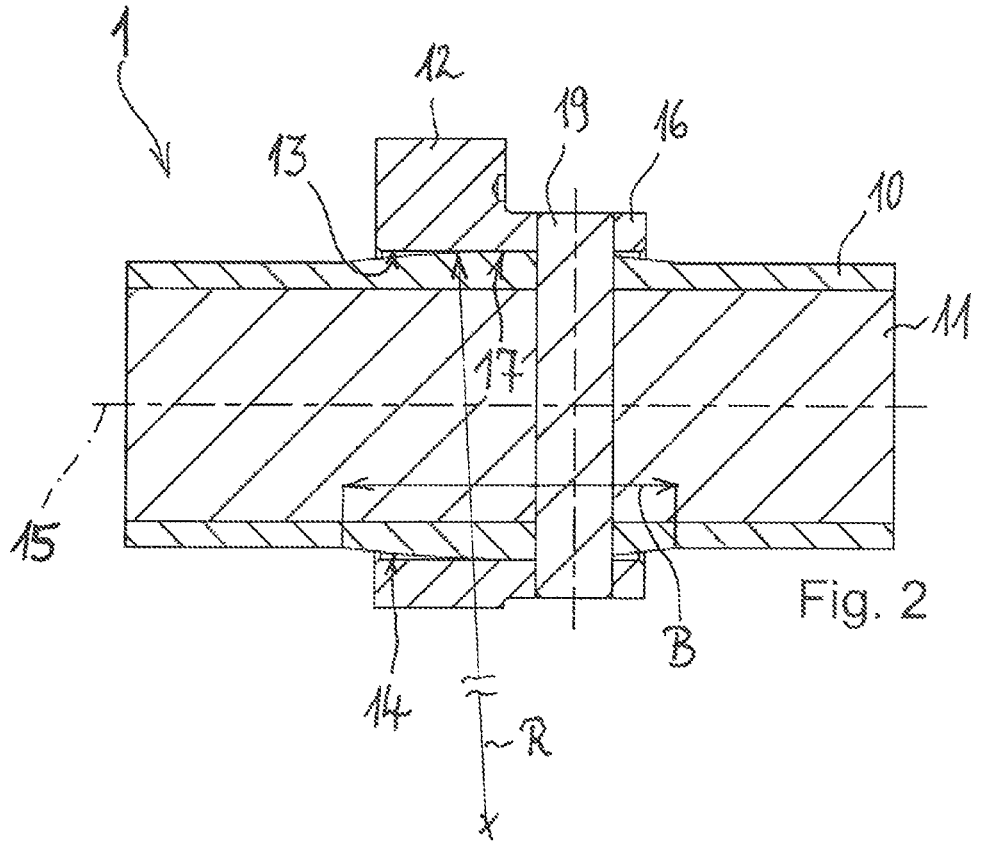
FIG. 2 is a cross-sectional view of an example adjustable camshaft including a spherical bearing surface formed by an outer side of an outer shaft, wherein the spherical bearing surface is wider than a width of a cam element.

FIG. 2 shows a further exemplary embodiment of an adjustable camshaft 1 with a spherical shape of the bearing surface 14, which has a width B which, in this exemplary embodiment, is greater than the width of the cam element 12. In this way, the radius R which defines the spherical shape can be defined with a larger value. Consequently, the region of the radial gap constriction 17 is also enlarged, giving rise to an increased load-bearing capacity of the plain bearing arrangement. As is also been stated in conjunction with FIG. 1, it is also alternatively possible for the spherical shape, in particular according to this exemplary embodiment, to be formed in the manner of a polygon composed of multiple radii adjacent to one another in the direction of the longitudinal axis 15.

Figure 3:
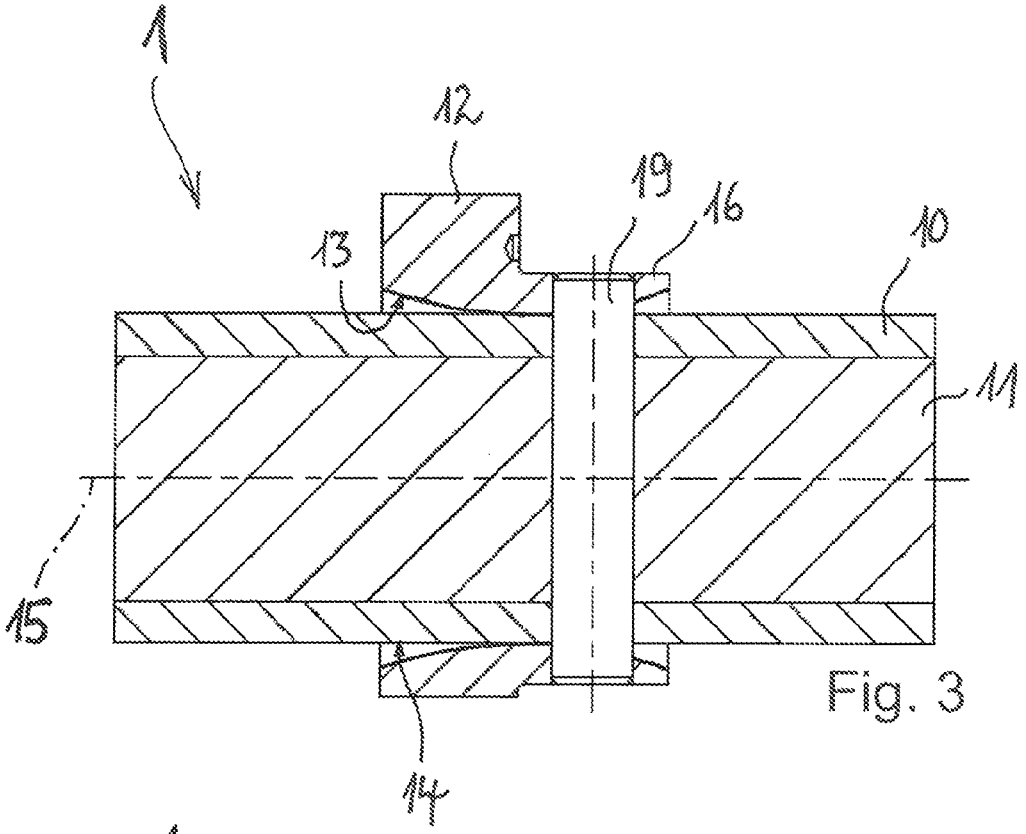
FIG. 3 is a cross-sectional view of an example adjustable camshaft including a spherical internal bearing surface in a shaft passage of a cam element.

FIG. 3 shows an exemplary embodiment of the adjustable camshaft 1 with a spherical shape of the internal bearing surface 13 in the shaft passage of the cam element 12. The spherical shape is of approximately symmetrical form, such that, in the event of mechanical load being exerted on the cam element 12, said cam element can perform a tilting movement relative to the longitudinal axis 15, which tilting movement can take place equally in two different tilting directions proceeding from the central position illustrated.

Figure 4:
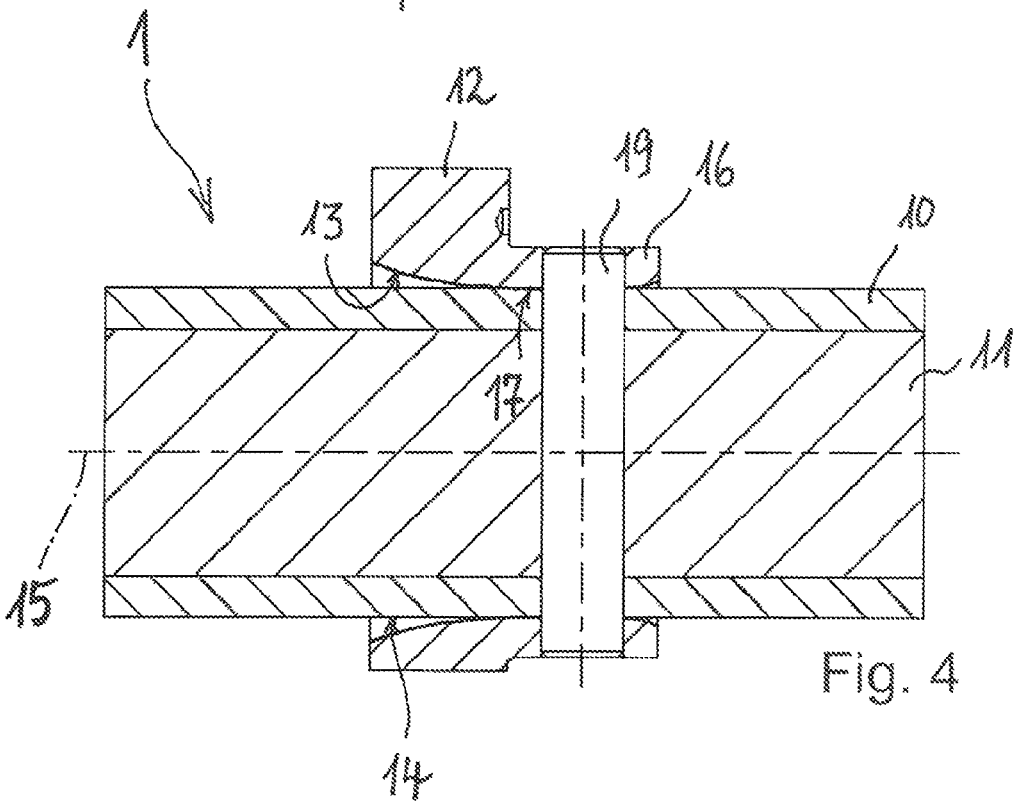
FIG. 4 is a cross-sectional view of an adjustable camshaft including an internal bearing surface formed by a shaft passage in a cam element, wherein the internal bearing surface has an asymmetrical spherical shape.

FIG. 4 shows an exemplary embodiment of the adjustable camshaft 1 with a spherical contour of the bearing surface 13 in the shaft passage of the cam element 12, wherein, in a modification of the exemplary embodiment as per FIG. 3, the spherical shape of the bearing surface 13 is of asymmetrical form, such that the radial gap constriction 17 is formed in the direction of the cam collar 16. The cam element 12 has a cam collar 16, wherein the spherical shape increases in size with an increasing radial gap toward the left in the plane of the illustration. Thus, the bearing gap between the bearing surfaces 13 and 14 opens toward the left. If forces act on the cam element 12, the latter can perform a slight tilting movement by virtue of the bearing surface 13 rolling on the bearing surface 14.

Figure 5:
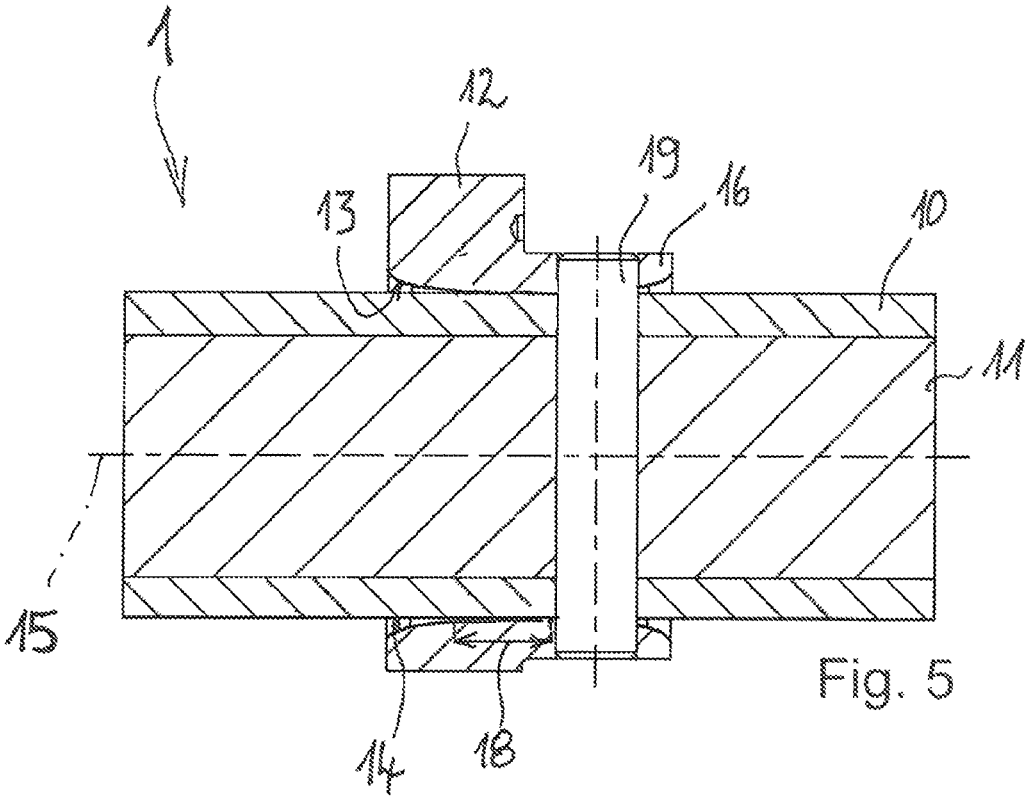
FIG. 5 is a cross-sectional view of an adjustable camshaft including a spherical internal bearing surface in a shaft passage of a cam element, wherein the spherical internal bearing surface has a cylindrical section.

FIG. 5 shows an embodiment of the adjustable camshaft 1 with a bearing surface 13 which has a cylindrical section 18. The cylindrical section 18 is adjoined on both sides by spherical sections of the bearing surface 13 in the shaft passage of the cam element 12. Said spherical sections form terminations of the shaft passage with transitions into radii, such that, owing to the spherical form of the bearing surface 13 shown, it is possible in a particular manner for edge loading to be avoided, wherein the cylindrical section 18 between the spherical regions makes it possible to realize a high load-bearing capacity of the plain bearing arrangement. Here, the spherical sections may in particular transition in edge-free and step-free fashion into the cylindrical section 18, such that regions of increased mechanical stress are avoided.

Figure 6:
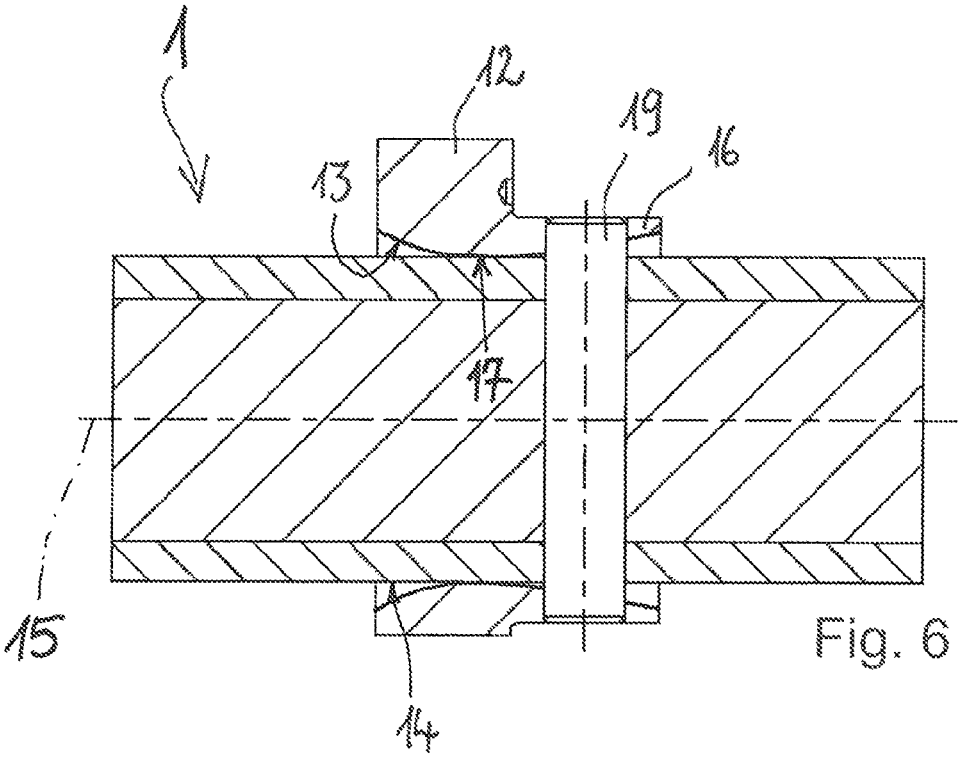
FIG. 6 is a cross-sectional view of an adjustable camshaft including a spherical shape in a bearing surface formed by a shaft passage in a cam element, wherein the spherical shape has as asymmetrical form.

FIG. 6 shows, in a modification of the exemplary embodiment from FIG. 5, an asymmetrical design of a spherical shape of the bearing surface 13 in the shaft passage of the cam element 12. Here, the region of an illustrated radial gap constriction 17 lies under the cam contour of the cam element 12, adjacent to the cam collar 16, whereby a possible exemplary embodiment of an asymmetrical spherical shape of the bearing surface 13 is shown. The region of the radial gap constriction 17 may in this case also be situated under the cam collar 16, if the bearing surface 13 in the shaft passage of the cam element 12 is formed with an asymmetrical spherical shape.

The spherical shape in the bearing surfaces 13 and 14, as illustrated in FIG. 1 to FIG. 6, is illustrated graphically in greatly exaggerated form, and the illustration of the spherical shapes, which is not true to scale, in the bearing surfaces 13 and 14 serves merely for the visualization of the spherical shape. In fact, the spherical shapes are extremely slight, and exhibit radial height deviations of the spherical shapes in the range of a few micrometers, for example 1 μm to 15 μm.

The invention is not restricted in terms of its embodiment to the preferred exemplary embodiment specified above. Rather, numerous variants are conceivable which make use of the illustrated solution even in embodiments of fundamentally different type. All of the features and/or advantages that emerge from the claims, from the description or from the drawings, including structural details and/or spatial arrangements, may be essential to the invention both individually and in a wide variety of combinations.

What is claimed is:

1. An adjustable camshaft for a valve drive of an internal combustion engine, the adjustable camshaft comprising:

an outer shaft;

an inner shaft that extends through the outer shaft;

a cam element disposed on the outer shaft, the cam element being rotationally conjointly connected to the inner shaft and including a shaft passage with an internal bearing surface; and a bearing surface disposed on an outer side of the outer shaft, wherein the bearing surface on the outer side of the outer shaft and the internal bearing surface of the cam element form a plain bearing arrangement for rotatably mounting the cam element on the outer shaft, wherein at least one of the internal bearing surface of the cam element or the bearing surface on the outer side of the outer shaft is formed at least in sections with a spherical shape.

2. The adjustable camshaft of claim 1 wherein the bearing surface on the outer side of the outer shaft has a spherical shape and is at least as wide as the plain bearing arrangement in a direction of a longitudinal axis along which the inner and outer shafts extend.

3. The adjustable camshaft of claim 1 wherein the internal bearing surface of the shaft passage has at least in sections a spherical shape such that a diameter of the shaft passage is smaller at an inside than at a margin.

4. The adjustable camshaft of claim 1 wherein the spherical shape is of a symmetrical form with respect to a longitudinal axis along which the inner and outer shafts extend.

5. The adjustable camshaft of claim 1 wherein the spherical shape is of an asymmetrical form.

6. The adjustable camshaft of claim 1 wherein the cam element comprises a cam collar, wherein the spherical shape is of an asymmetrical form such that a radial gap constriction between the internal bearing surface of the cam element and the bearing surface on the outer side of the outer shaft is formed in a section of the cam collar.

7. The adjustable camshaft of claim 1 wherein the bearing arrangement comprises a cylindrical section that is formed adjacent to the spherical shape.

8. The adjustable camshaft of claim 1 wherein the spherical shape has a radial height of 1 to 15 μm.

9. The adjustable camshaft of claim 1 wherein the spherical shape has a radial height of 4 to 6 μm.

10. The adjustable camshaft of claim 1 wherein the spherical shape permits the cam element to tilt away from a position where the cam element is orthogonal to a longitudinal axis along which the inner and outer shafts extend.

11. An adjustable camshaft comprising:

an outer shaft;

an inner shaft that extends through the outer shaft, wherein both the inner and outer shafts extend along a longitudinal axis;

a cam element disposed on the outer shaft, the cam element being coupled to the inner shaft so as to rotate with the inner shaft, the cam element comprising a shaft passage having an internal bearing surface; and a bearing surface disposed on an outer side of the outer shaft that engages with the internal bearing surface of the shaft passage of the cam element so as to rotatably mount the cam element on the outer shaft, wherein at least a portion of the internal bearing surface of the cam element and at least a portion of the bearing surface on the outer side of the outer shaft are spherically-shaped.

* * * * *